US007107627B2

(12) United States Patent
Holland

(10) Patent No.: US 7,107,627 B2
(45) Date of Patent: Sep. 19, 2006

(54) HANDKERCHIEF VALET

(76) Inventor: James Bruce Holland, 14185 Silent Woods Dr., Shelby Woods Dr., MI (US) 48315

( * ) Notice: Subject to any disclaimer, the term of this patent is extended or adjusted under 35 U.S.C. 154(b) by 142 days.

(21) Appl. No.: 10/707,730

(22) Filed: Jan. 7, 2004

(65) Prior Publication Data

US 2005/0144705 A1 Jul. 7, 2005

(51) Int. Cl.
*A41D 27/20* (2006.01)

(52) U.S. Cl. ..... 2/247; 2/249; 2/279

(58) Field of Classification Search ..... 2/247, 2/248, 249, 250, 251, 252, 253, 279
See application file for complete search history.

(56) References Cited

U.S. PATENT DOCUMENTS 2,777,133 A * 1/1957 Phillips, Jr. ..... 2/279
2,778,080 A * 1/1957 Kernicki ..... 24/3.5
3,072,917 A * 1/1963 Watson, Jr. ..... 2/279
3,135,967 A * 6/1964 Stephens ..... 2/279
3,184,759 A * 5/1965 Masters ..... 2/279
3,196,461 A * 7/1965 Erhardt ..... 2/279
3,412,435 A * 11/1968 Poppe ..... 24/3.7
3,512,182 A * 5/1970 Bezanilla ..... 2/279
3,786,520 A * 1/1974 Harmon ..... 2/279
4,083,446 A * 4/1978 Schuchman, Sr. ..... 206/38
5,231,702 A * 8/1993 Masters ..... 2/244
5,253,370 A * 10/1993 Mead ..... 2/279
6,839,915 B1 * 1/2005 Yoshimura ..... 2/250

* cited by examiner

*Primary Examiner*—Gary L. Welch

(57) ABSTRACT

The main feature of the handkerchief valet is that it continually maintains the handkerchief in the same shape and height in the upper exterior left side chest pocket of a suit coat or sports coat or jacket as originally positioned.

20 Claims, 3 Drawing Sheets

HANDKERCHIEF VALET

BACKGROUND OF INVENTION

The invention named above as the handkerchief valet (hv) and presented herein, is associated with the clothing and wearing apparel field. More specifically, the handkerchief valet is an item used to improve and maintain the neat appearance of the handkerchief folds protruding outward from the upper left side exterior chest pocket of a suit or sports coat or jacket. Most well-groomed persons finds it necessary to insert a color coordinated attire matching handkerchief in the upper left side chest pocket.

The problem heretofore has been that the handkerchief does not maintain its shape and height in the pocket as positioned. Over time, the handkerchief looses its shape and height and is no longer flattering or disappears inside of the pocket altogether. The handkerchief valet provides a remedy for the disheveled and disappearing handkerchief in the chest pocket.

SUMMARY OF THE INVENTION

The handkerchief valet is a removable pouch utilized for the purpose of inserting and holding in place, a handkerchief folded as desired, to be placed in the upper left side exterior chest pocket (chest pocket) of a suit coat or sports jacket. See pictures FIGS. #1A and #1B on drawing FIG. 1

DETAILED DESCRIPTION

Figure 1:
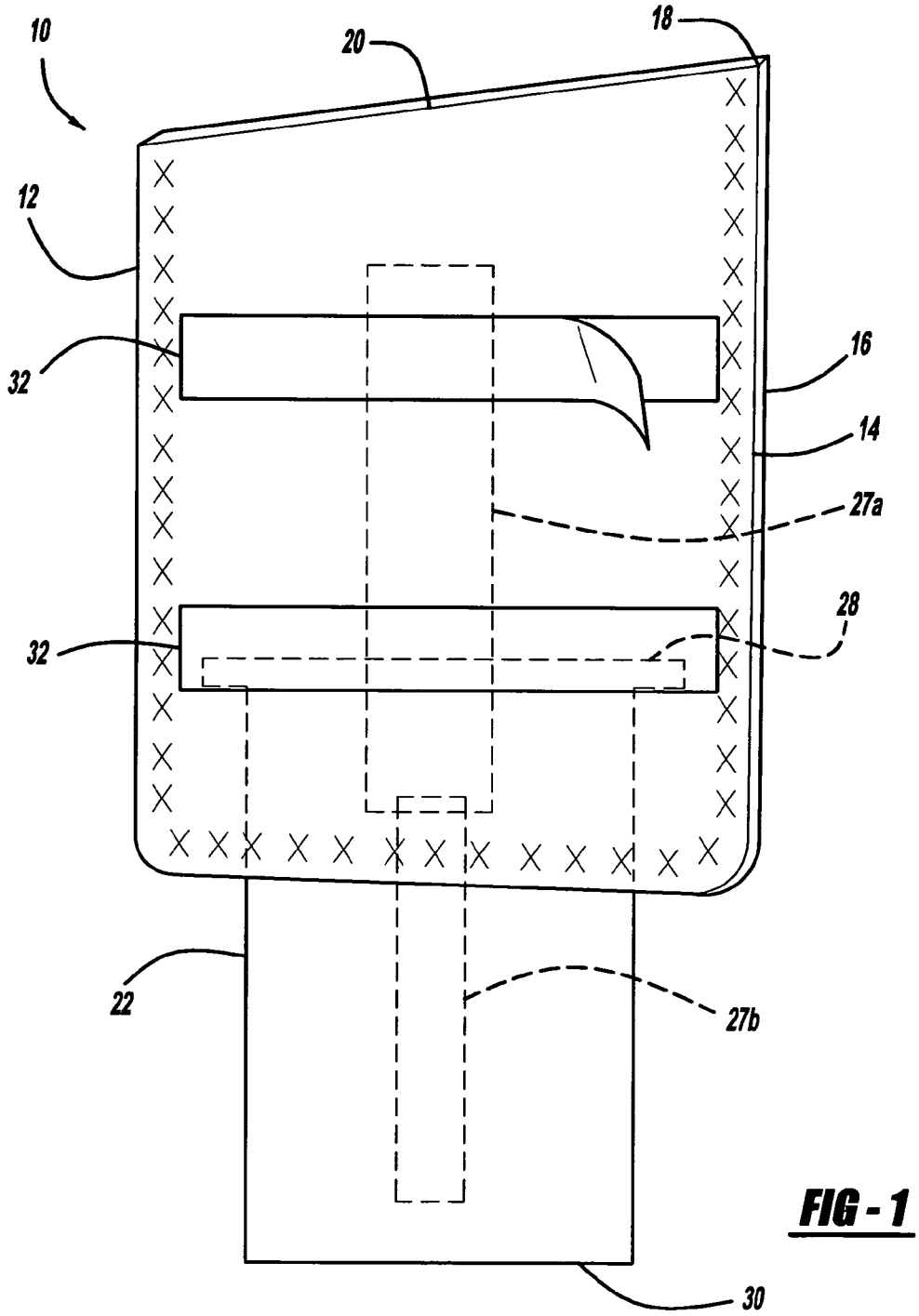
FIG. 1 is the front view of the handkerchief Valet.
Figure 2:
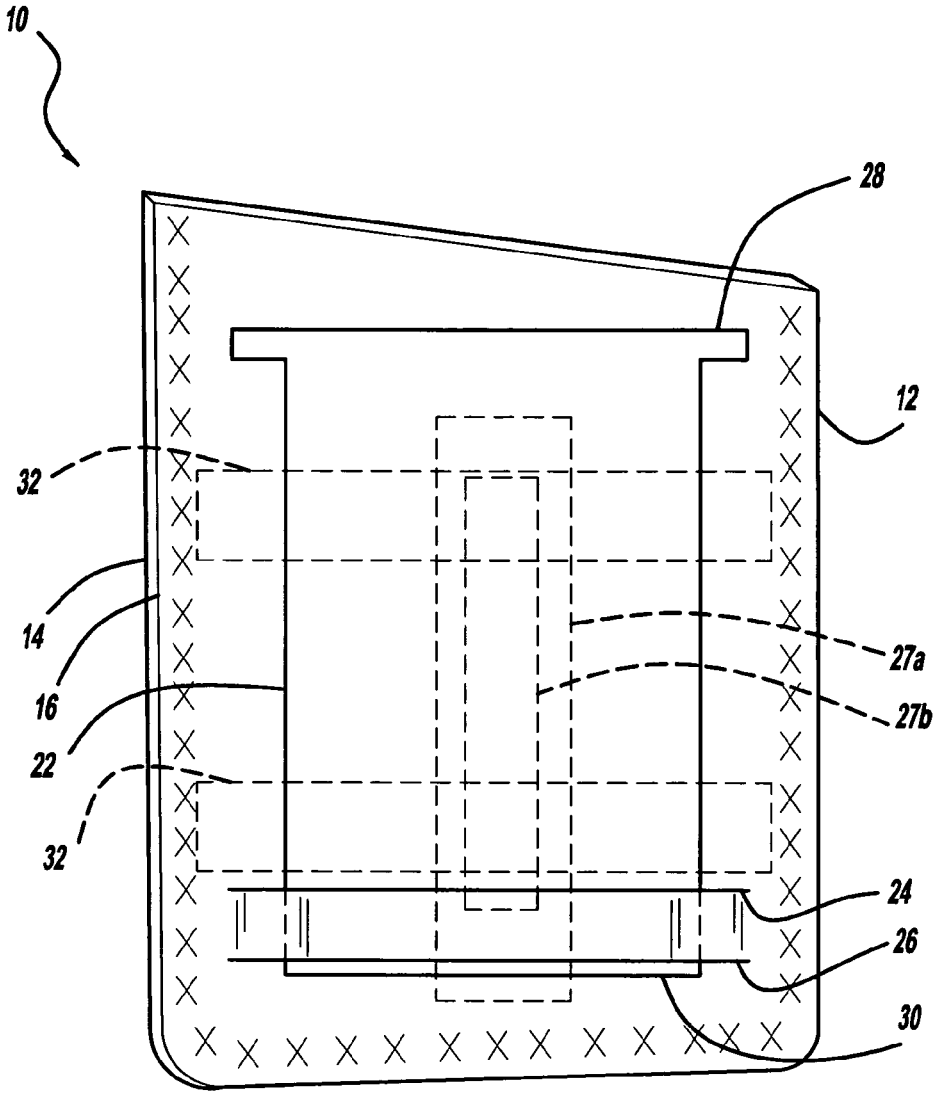
FIG. 2 is the back side view of the handkerchief valet showing a retracted extension tab and Velcro or double-sided adhesive tape (vc/d sat).
Figure 3:
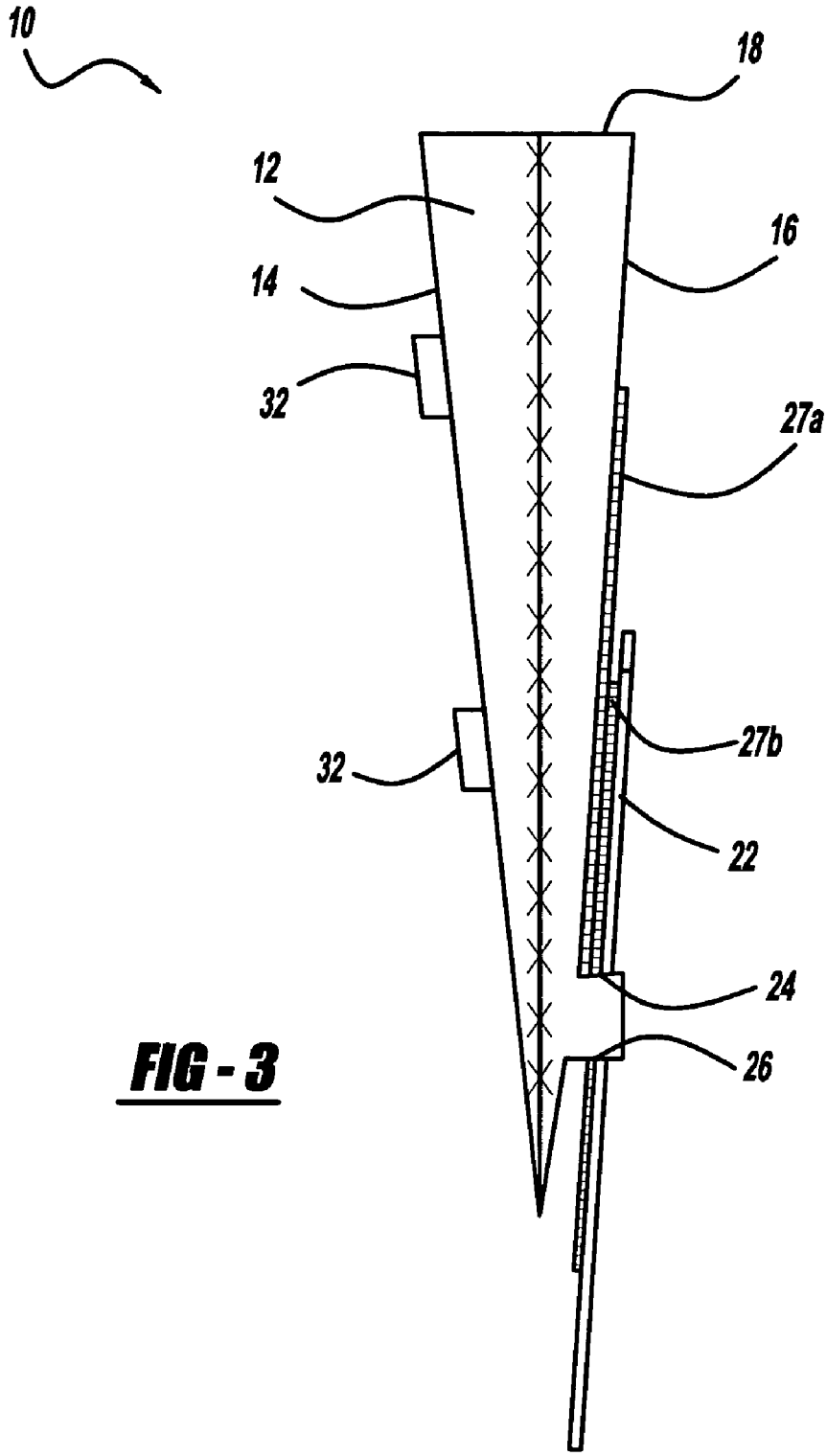
FIG. 3 is the right side end view of the handkerchief valet.

Referring to FIGS. 1–3, a handkerchief valet 10 can be made from heavy grade card board paper or plastic or cloth or leather materials. Essentially, the handkerchief valet 10 has a body 12 that is made from two pieces of equally shaped material sewed, a front portion 14 and a rear portion 16, stapled or otherwise bonded firmly together around the outside edges on three sides. A top side 18 is left open for insertion of the handkerchief into a fairly tight gap formed by joining of the front portion 14 and the rear portion 16.

The shape of the handkerchief valet assimilates the average shape of the exterior upper left side chest pocket of a suit coat or sports jacket. In the preferred embodiment the handkerchief valet has a width of three and one-half inches (3½") and the height is four and three-quarter inches (4¾) on the right side and four and one-quarter inches (4¼") on the left side. Thus, the top side 18 has an angled surface 20, which preferably is a similar angle to that of a suit coat or sports jacket. The bottom is level.

Because chest pockets vary in depth, the handkerchief valet 10 will have an extension tab 22 that can increase the depth size of the handkerchief valet 10. The preferred maximum height of the handkerchief valet 10 is seven inches (7"). The extension tab 22 preferable has a rectangular shape, which is made from the same materials as described above. The preferred size of the extension tab 22 will be two and one-quarter inches (2¼") wide by three and one-half inches (3½") long, which is a first longitudinal dimension.

The extension tab 22 will be connect to the rear portion 14 and is inserted into a first slit 24 and out of a second slit 26 which are preferably located five-sixteenth of an inch ({fraction (5/16)}") apart. In addition, the edges of the slits 24, 26 will have reinforced stitching to accommodate wearing. In the preferred embodiment the top of the first slit 24 is seven-eights of an inch (⅞") from the bottom of the body 12.

The rear portion 16 and the extension tab 22 will be bonded by an adhesive strip, such as but not limited to, Velcro, a hook and loop fastener, or double sided adhesive tape (vc/dsat) 27. By applying the vc/dsat 27, this will enable the individual to change and hold the desired height selling firmly in place. In the preferred embodiment Velcro is used and the Velcro 27*a* on the extension tab 22 is one inch (1") wide by three and one-quarter inch (3¼") in length. It is also preferred that the Velcro 27*b* on the handkerchief valet 10 is (1") wide by (3¾") in length. Thus, the adhesive strip has a second longitudinal dimension. The number of customizable adjustments is dependent upon the first longitudinal dimension of the extension tab 22 and the second longitudinal dimension of the adhesive strip 27. Moreover, the extension tab 22 has a top 28 that has a length that is greater than the length of the slits 24, 26 so that the top 28 cannot pass through the slits 24, 26. In addition, the extension tab 22 has a base 30 which has a length that is shorter than the length of the slits 24, 26 so that the base 30 can pass through the slits 24, 26.

So that the handkerchief valet 10 does not accidentally fall out of the chest pocket, it is preferred that there are two strips of double sided adhesive tape (dsat) 32 to prevent slippage. In the preferred embodiment the size of the two strips of dsat 32 will be one-half inch (½") wide by three inches (3") in length. The two strips of dsat 32 will be placed on the front side of the handkerchief valet 10 horizontally, one inch (1") from the left side and one inch (1") from the bottom.

The invention claimed is:

1. A handkerchief holder comprising:

a body, wherein said body has a front portion and a rear portion and said front portion and said rear portion are connected on three sides;

an extension tab having a first longitudinal dimension, wherein said extension tab is connected to said body by an adhesive strip having a second longitudinal dimension to provide a customizable adjustment between said body and said extension tab;

a plurality of slits on said rear portion, such that said extension tab can extend through said plurality of slits;

at least one double sided adhesive tape strip connected to said front portion; and, a top of said front portion and a top of said rear portion is angled, such that a first side of said body is longer than a second side of said body.

2. The handkerchief holder of claim 1, wherein said adhesive strip is a hook and loop fastener.

3. The handkerchief holder of claim 1, wherein a top of said extension tap is longer than a bottom of said extension tab, such that length of said bottom is smaller than the length of said plurality of slits, and length of said top is greater than the length of said plurality of slits.

4. A handkerchief holder comprising:

a body, wherein said body has a front portion and a rear portion, and said front portion and said rear portion are connected on three sides; and an extension tab having a first longitudinal dimension, wherein said extension tab is connected to said body by an adhesive strip having a second longitudinal dimension to provide a customizable adjustment between said body and said extension tab.

5. The handkerchief holder of claim 4, wherein said adhesive strip is at least one of a hook and loop fastener and double side adhesive tape.

6. The handkerchief holder of claim 4, wherein a top of said front portion is angled, such that a first side of said body is longer than a second side of said body.

7. The handkerchief holder of claim 4 further comprising at least one double sided adhesive tape strip connected to said front portion.

8. The handkerchief holder of claim 4, wherein said rear portion has a plurality of slits such that said extension tab can extend through said plurality of slits.

9. The handkerchief holder of claim 8, wherein a top of said extension tap is longer than a bottom of said extension tab, such that length of said bottom is smaller than the length of said plurality of slits, and length of said top is greater than the length of said plurality of slits.

10. A handkerchief holder comprising:

a body, wherein said body has a front portion and a rear portion, and said front portion and said rear portion are connected;

an extension tab having a first longitudinal dimension, wherein said extension tab is connected to said body by an adhesive strip having a second longitudinal dimension to provide a customizable adjustment between said body and said extension tab; and a plurality of slits on said rear portion, wherein said extension tab extends through said plurality of slits.

11. The handkerchief holder of claim 10, wherein said adhesive strip is at least one of a hook and loop fastener and double sided adhesive strip.

12. The handkerchief holder of claim 10, wherein a top of said front portion is angled, such that a first side of said body is longer than a second side of said body.

13. The handkerchief holder of claim 10 further comprising at least one double sided adhesive tape strip connected to said front portion.

14. The handkerchief holder of claim 10, wherein said front portion is connected to said rear portion on three sides.

15. The handkerchief holder of claim 10, wherein a top of said extension tap is longer than a bottom of said extension tab, such that length of said bottom is smaller than the length of said plurality of slits, and length of said top is greater than the length of said plurality of slits.

16. A handkerchief holder comprising:

a body, wherein said body has a front portion and a rear portion, and said front portion and said rear portion are connected;

an extension tab having a first longitudinal dimension, wherein said extension tab is connected to said body by an adhesive strip having a second longitudinal dimension to provide a customizable adjustment between said body and said extension tab;

a plurality of slits on said rear portion, wherein said extension tab extends through said plurality of slits; and a top of said extension tab having a longer length than a bottom of said extension tab, wherein said length of said bottom is shorter than the length of said plurality of slits and said length of said top is greater than the length of said plurality of slits.

17. The handkerchief holder of claim 16, wherein said adhesive strip is at least one of a hook and loop fastener and double sided adhesive strip.

18. The handkerchief holder of claim 16, wherein a top of said front portion is angled, such that a first side of said body is longer than a second side of said body.

19. The handkerchief holder of claim 16 further comprising at least one double sided adhesive tape strip connected to said front portion.

20. The handkerchief holder of claim 16, wherein said front portion is connected to said rear portion on three sides.

* * * * *